US008740580B2

(12) United States Patent
Jost et al.

(10) Patent No.: US 8,740,580 B2
(45) Date of Patent: Jun. 3, 2014

(54) REFRIGERANT COMPRESSOR

(75) Inventors: Manfred Jost, Feldbach (AT); Walter Brabek, Fürstenfeld (AT)

(73) Assignee: Secop Austria GmbH, Fuerstenfeld (AT)

( * ) Notice: Subject to any disclaimer, the term of this patent is extended or adjusted under 35 U.S.C. 154(b) by 431 days.

(21) Appl. No.: 12/226,535

(22) PCT Filed: May 22, 2007

(86) PCT No.: PCT/EP2007/054953
§ 371 (c)(1),
(2), (4) Date: Oct. 21, 2008

(87) PCT Pub. No.: WO2007/135152
PCT Pub. Date: Nov. 29, 2007

(65) Prior Publication Data

US 2009/0175741 A1 Jul. 9, 2009

(30) Foreign Application Priority Data

May 22, 2006 (AT) ..... GM411/2006

(51) Int. Cl.
*F04B 39/00* (2006.01)
*F04B 53/00* (2006.01)

(52) U.S. Cl.
USPC ..... 417/312

(58) Field of Classification Search
USPC ..... 417/312, 902; 220/601, 661; 62/469
See application file for complete search history.

(56) References Cited

U.S. PATENT DOCUMENTS

| | | | | |
|---|---|---|---|---|
| 3,209,991 | A * | 10/1965 | Sauber | 417/415 |
| 5,322,419 | A | 6/1994 | Novolan et al. | |
| 6,257,846 | B1 * | 7/2001 | Muramatsu et al. | 417/410.3 |
| 6,607,369 | B1 | 8/2003 | Yanase et al. | |
| 6,637,216 | B1 | 10/2003 | Narney | |
| 2004/0241011 | A1 * | 12/2004 | Yagi et al. | 417/312 |
| 2005/0135941 | A1 * | 6/2005 | Seo | 417/312 |

FOREIGN PATENT DOCUMENTS

| | | | |
|---|---|---|---|
| JP | 61-241472 | 10/1986 | |
| JP | 63280885 | * 11/1988 | F04C 23/02 |
| JP | 02-146274 | 6/1990 | |
| JP | 2004-100661 | 4/2004 | |
| JP | 2005-282544 | 10/2005 | |
| WO | WO 03/081044 | 10/2003 | |

OTHER PUBLICATIONS

International Search Report, Sep. 2007.

* cited by examiner

*Primary Examiner* — Bryan Lettman
(74) *Attorney, Agent, or Firm* — Collard & Roe, P.C.

(57) ABSTRACT

A hermetically encapsulated refrigerant compressor has a hermetically sealed compressor housing, in the interior of which operates a refrigerant-compressing piston-cylinder unit, a suction duct, via which refrigerant is conveyed into the compressor housing, and a pressure duct, via which refrigerant is conveyed out of the compressor housing by the piston-cylinder unit. In order to prevent contact of oil flowing down the compressor housing wall with the suction duct or the pressure duct, a deflection element is on the compressor housing, and in the operating position of the compressor housing the deflection element is above the passage of the suction duct or pressure duct through the compressor housing wall. The heating of the refrigerant is thus prevented and the efficiency of the refrigerant compressor is increased.

8 Claims, 3 Drawing Sheets

PRIOR ART Fig. 1
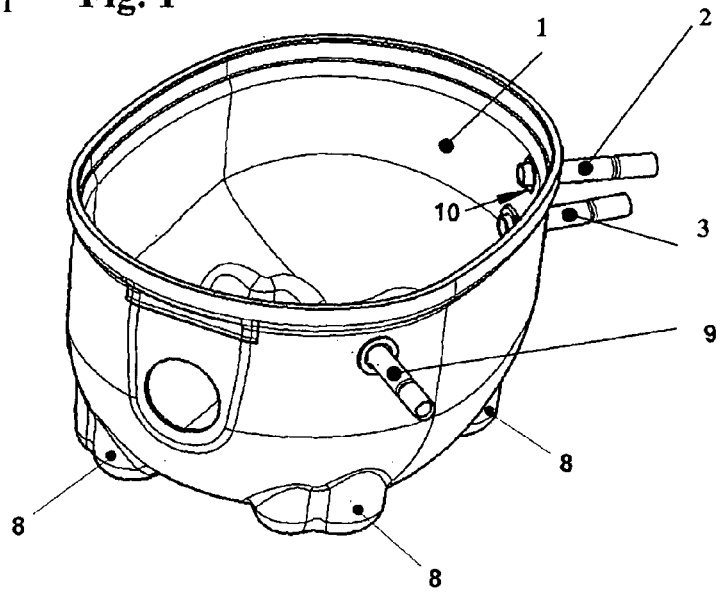
PRIOR ART Fig. 2
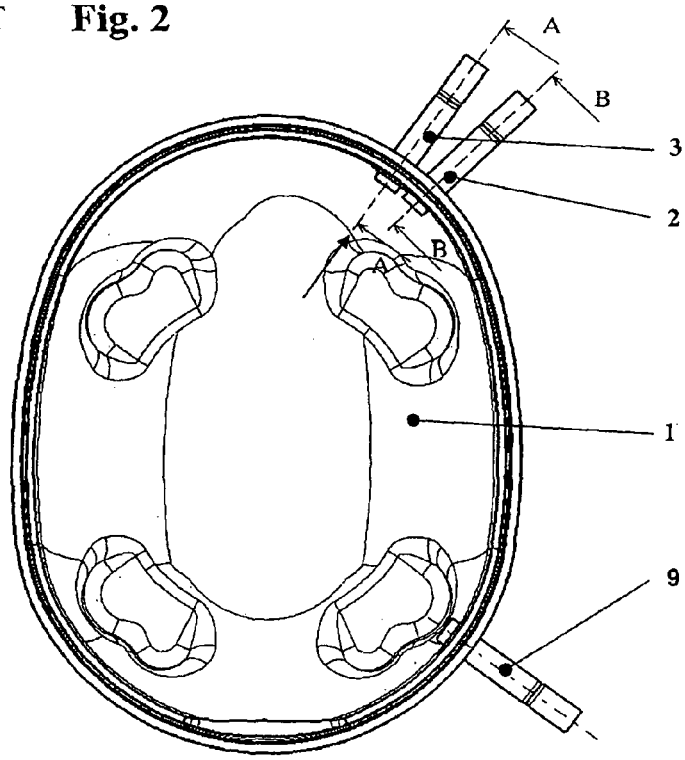

PRIOR ART Fig. 3
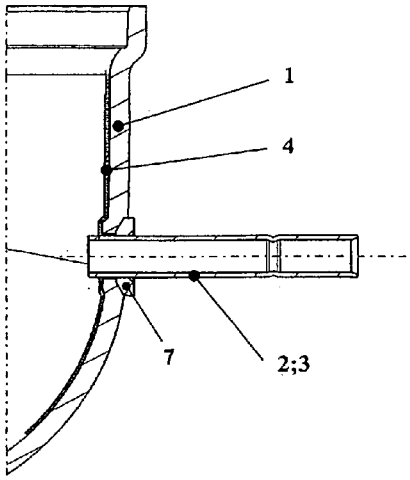
Fig. 4
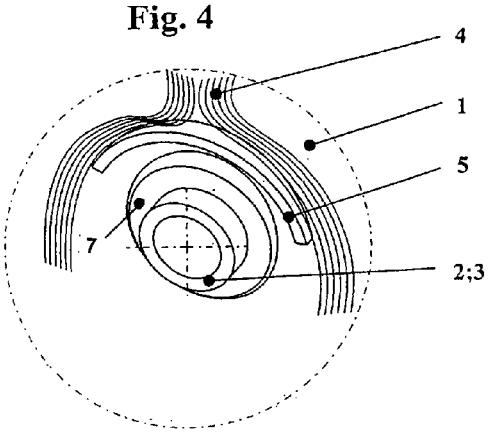
Fig. 5
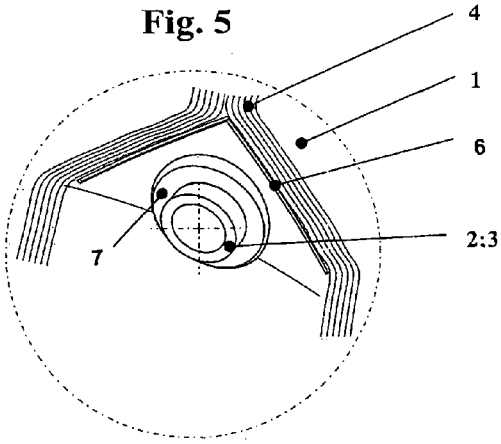
Fig. 6
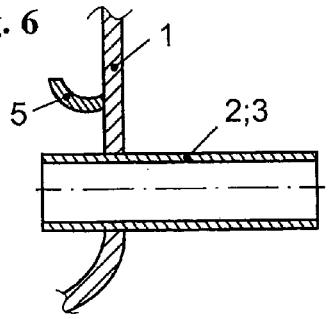
Fig. 7
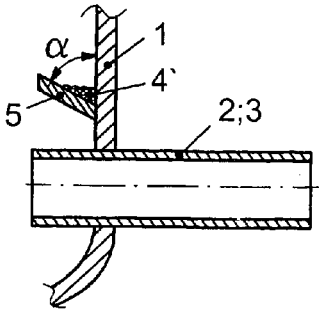

REFRIGERANT COMPRESSOR

CROSS REFERENCE TO RELATED APPLICATIONS

This application is the National Stage of PCT/EP2007/054953 filed on May 22, 2007, which claims priority under 35 U.S.C. §119 of Austrian Application No. GM 411/2006 filed on May 22, 2006. The international application under PCT article 21(2) was not published in English.

FIELD OF THE INVENTION

The present invention relates to a hermetically encapsulated refrigerant compressor which has a hermetically sealed compressor housing, in the interior of which operates a refrigerant-compressing piston-cylinder unit and is provided with a suction duct, via which refrigerant is conveyed into the compressor housing or in a suction muffler connected to the piston-cylinder unit, and is provided with a pressure duct, via which refrigerant is conveyed out of the compressor housing by the piston-cylinder unit.

Such refrigerant compressors are used in the field of households and the industry where they are mostly arranged on the rear side of a refrigerator or refrigerated case. It is their task to compress and further convey refrigerant circulating in the cooling system, thus dissipating heat from the interior of the refrigerating, passing it on to the ambient environment and a refrigerating chamber or refrigerated case are thus refrigerated in the known manner.

The refrigerant compressor, which comprises a hermetically-sealed compressor housing, has an electric motor which drives a piston oscillating in a cylinder via a crankshaft to compress the refrigerant. The compressor housing consists of a cover part and a base part and connection openings, with a suction duct, a pressure duct and other ducts optionally being provided which lead into and out of the compressor housing to convey the refrigerant to the cylinder and therefrom further in the refrigerant loop. Before the refrigerant drawn into the suction duct reaches the piston-cylinder unit, it is guided through a suction muffler which has the task of absorbing or reducing the noise caused by the refrigerant circulation and the piston and valve movements.

In order to lubricate the parts of the piston-cylinder unit sliding along each other on the one hand, and to ensure cooling of the piston-cylinder unit on the other hand, an oil pump is provided which supplies the piston-cylinder unit with oil.

The oil circulating in this manner within the compressor housing is swirled either via suitable nozzles or via rotational elements attached to the crankshaft and supplied to the desired areas of the compressor system.

It is desirable in this case that the swirling and heated oil continuously also settles on the compressor housing wall and the heat absorbed from the oil is passed on to the compressor housing and is further dissipated to the ambient environment.

It is not desirable in this connection however that a heat exchange occurs by the oil from the suction duct and to the pressure duct. If the heated oil which has settled on the compressor housing wall and flows off from the same in a predetermined direction by gravity comes into contact with the suction duct, the same will be heated in an undesirable manner and supplies the heat thus supplied also to the refrigerant that is transported in the suction duct and is directly before the compression process. An increase in the intake temperature of the refrigerant causes an adverse effect in the efficiency of the refrigerant compressor and should be avoided at all cost.

The pressure duct indirectly also causes an additional heating of the compressor housing and the suction duct. Since the compressed refrigerant which is removed in the pressure duct has temperatures of up to 100° C., there is also a strong heating of the pressure duct, which is why the refrigerant pushed out by the piston-cylinder unit should be conveyed out of the compressor housing as hot as possible.

If the oil flowing off the compressor wall comes into contact with the hot pressure duct, the oil that is at a lower temperature level will absorb heat in an undesirable manner and passes the same on to the compressor housing because it circulates within the compressor housing, leading to a heating of the entire interior space of the compressor housing, which also includes the suction duct and the piston-cylinder unit.

In view of the large number of refrigerant compressors all over the world, any degree of improvement in the efficiency made in a refrigerant compressor leads to a considerable potential in energy savings which is becoming increasingly more important in view of the globally diminishing energy resources.

The greatest and most important potential for a possible improvement of the efficiency is the reduction of the temperature of the refrigerant drawn in at the beginning of the compression process. Any reduction of this so-called intake temperature therefore causes, like the reduction of the temperature during the compression process and, connected thereto, the expulsion temperature, a reduction of the required technical work for the compression process.

DESCRIPTION OF THE PRIOR ART

A baffle plate in the area of the entrance of the suction tube into the compressor housing is known from U.S. Pat. No. 6,637,216, which plate is used to prevent fluid refrigerant or lubricant drawn through the suction tube enters a section of the suction tube leading into the cylinder and thus reaches the cylinder. The arrangement of this baffle plate depends on the gas flowing into the compressor housing, through which the plate can have relatively narrow dimensions.

SUMMARY OF THE INVENTION

It is therefore the goal of the present invention to prevent contact of oil flowing down the compressor housing wall with the suction duct and the pressure duct in order to prevent a heating of the refrigerant within the compressor housing and to thus increase the efficiency of the refrigerant compressor.

This object is achieved by a hermetically encapsulated refrigerant compressor as described herein.

A generic refrigerant compressor comprises a hermetically sealed compressor housing, in the interior of which a piston-cylinder unit works which compresses the refrigerant and which is supplied with refrigerant via a suction duct opening or guided into the compressor housing and is connected with a pressure duct leading out of the compressor housing.

It is provided in accordance with the invention that in the operating position of the compressor housing deflection means are provided on the same above the passage of the suction duct and pressure duct through the compressor housing wall, which deflection means prevent contact of oil flowing down the compressor housing wall with the suction duct or pressure duct.

The arrangement in accordance with the invention prevents a heat exchange between oil and suction duct and pressure duct. It is especially prevented that the downwardly flowing oil will heat the suction duct and that the pressure duct will heat the downwardly flowing oil.

It is prevented that the refrigerant that is directly before the compression process will heat up in an undesirable manner. An increase in the efficiency of the refrigerant compressor is thus achieved.

According to a particular embodiment, the deflection means concern at least one guide extension that protrudes inwardly from the compressor housing wall. Such a guide extension screens the suction duct or pressure duct reliably from the oil flowing down the compressor housing wall, such that the oil can flow or drip off along the longitudinal extension of the guide extension without wetting the suction duct or pressure duct.

The deflection means disposed above the suction duct or pressure duct may also concern at least one recess provided directly in the compressor housing wall instead of the guide extension, as was seen through trials, which recess causes a sufficient screening of the suction duct or pressure duct from the downwardly flowing oil, such that the oil flowing down the compressor housing wall follows the progression of the recess and is thus guided around the suction duct 2 or pressure duct 3.

In a preferred embodiment, the guide extension is substantially arranged in the shape of a V, with the tip of the V being arranged above the suction duct or pressure duct in the operating position of the compressor housing. The respective V-shape is easy to produce and enables a direct deflection of the downwardly flowing oil from the direct area of the suction duct or pressure duct, such that the downwardly flowing oil stream is split to the left and right at the tip of the V and flows according to gravity along the two legs of the V without making contact with the suction duct or pressure duct.

In order to ensure that the oil flowing down along the compressor housing wall is guided around the suction duct and pressure duct and exclude any flight of droplets on the same, it is provided in an additional embodiment that the two legs of the V extend until beneath the suction duct or pressure duct.

The guide extension or the recess can have an umbrella-like configuration, which means that the guide extension or recess has an upwardly convex longitudinal extension (as seen in the operating position of the refrigerant compressor).

In order to prevent that creeping runs of oil continue from the upper side of the guide extension to its bottom side and consequently will reach the suction duct or pressure duct, it is provided in a particular embodiment that the guide extension comprises a groove-like cross-sectional profile or one that is concave in the direction averted in the suction duct or pressure duct.

In order to prevent any contact of the downwardly flowing oil with the suction duct or pressure duct by formation of drops and to prevent oil streams creeping about the deflection means, it can further be advantageous to arrange several guide extensions or recesses above one another. When a certain oil quantity overcomes the barrier formed by the first deflection means and approaches the suction duct or pressure duct according to gravity, it is ensured at the latest by the barrier formed by a second deflection means that said oil quantity is deflected from the suction duct or pressure duct and will not make contact with the same.

According to a further particular embodiment, the suction duct and/or the pressure duct is formed in the manner of a tube. The tubular cross section of suction duct and pressure duct allows simple connection of the same to the compressor housing by means of bores provided in the compressor housing or a suitable connection element.

BRIEF DESCRIPTION OF THE DRAWINGS

The invention is now explained in closer detail by reference to an embodiment, wherein:

FIG. 1 shows a basic part of a compressor housing in an oblique view;

FIG. 2 shows a basic part of a compressor housing in a top view;

FIG. 3 shows a partial sectional view of the compressor housing of FIG. 2 along the lines A-A and B-B;

FIG. 4 shows a detailed view of a deflection means in accordance with the invention according to the visual angle D of FIG. 2;

FIG. 5 shows a detailed view of a deflection means in accordance with the invention according to the visual angle D of FIG. 2;

FIG. 6 shows a schematic view of a guide extension in accordance with the invention in a sectional view along lines A-A and B-B of FIG. 2;

FIG. 7 shows a schematic view of a guide extension in accordance with the invention in a sectional view along the lines A-A and B-B of FIG. 2;

DETAILED DESCRIPTION OF THE PREFERRED EMBODIMENTS

Figure 8:
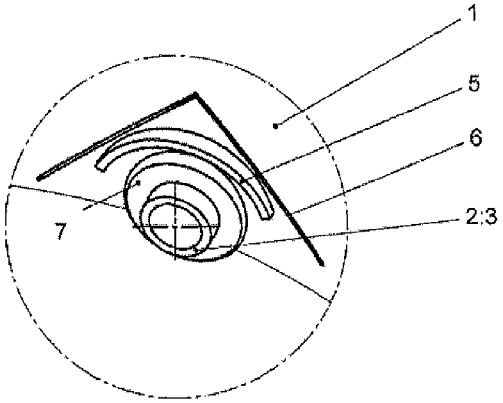
FIG. 8 shows a detailed view of a deflection means in accordance with an embodiment of the invention according to the visual angle D of FIG. 2 including a recess and a guide extension.
Figure 9:
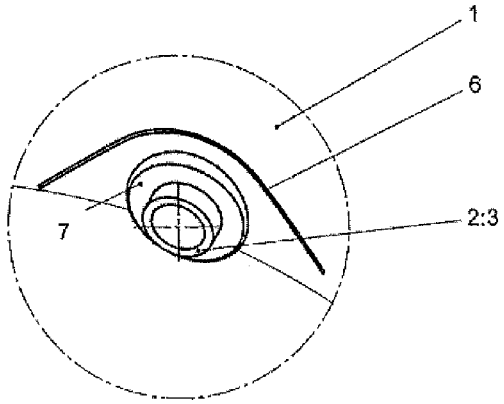
FIG. 9 shows a detailed view of a deflection means in accordance with an embodiment of the invention according to the visual angle D of FIG. 2 including a recess arranged substantially in the manner of an umbrella having an upwardly convex longitudinal extension.
Figure 10:
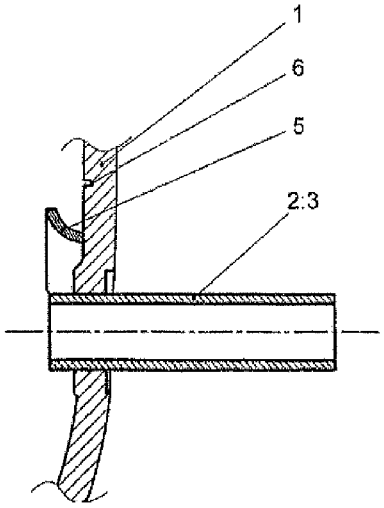
FIG. 10 shows a partial sectional view of a compressor housing in accordance with an embodiment of the invention in a sectional view along the lines A-A and B-B of FIG. 2, including a guide extension having a groove-like cross-sectional profile that is concave in the direction averted in the suction duct or pressure duct and including a recess provided in the compressor housing wall.
Figure 11:
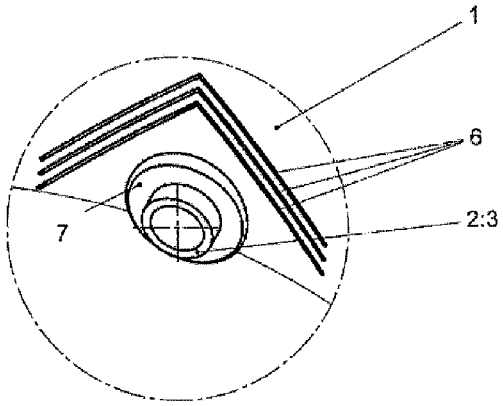
FIG. 11 shows a detailed view of a deflection means in accordance with an embodiment of the invention according to the visual angle D of FIG. 2 including several deflection elements arranged on top of one another.

The present refrigerant compressor comprises a hermetically sealed compressor housing 1, into which open a suction duct 2, a pressure duct 3 and a service tube 9 via connection openings 10.

In the known manner, a refrigerant flows via the suction duct 2 to a piston-cylinder unit (not shown) arranged within the compressor housing 1, in which the compression of the refrigerant occurs, with the pressure duct 3 further guiding the strongly heated refrigerant from the piston-cylinder unit from the compressor housing 1 to a cooling circulation (also not shown) of a refrigerating chamber. The piston-cylinder unit is driven by an electromotor via a crankshaft, so that the refrigerating chamber associated with the refrigerant compressor is continually cooled by means of the circulating refrigerant.

The refrigerant sucked in the suction duct 2 reaches the piston-cylinder unit via a suction muffler connected to the piston-cylinder unit in order to absorb the noise caused by the refrigerant circulation or the piston and valve movements. The suction duct 2 can open either freely into the compressor housing, with the refrigerant being sucked in this case from the compressor housing into the piston-cylinder unit, or the suction duct 2 is connected directly with the suction muffler, as a result of which the refrigerant is guided directly via the suction muffler into the piston-cylinder unit. In the former case the suction tube usually protrudes slightly into the interior of the compressor housing.

Suction duct 2 and pressure duct 3 are preferably arranged in a tubular way, but can also have other cross-sectional shapes. The compressor housing 1 comprises several base elements 8, by means of which it can be positioned on a thus predetermined base area of a refrigerating device.

Although FIG. 1 merely shows a base part of a compressor housing 1 in connection with FIG. 1, on which a cover part is placed, the compressor housing 1 can also be arranged in a different way, e.g. in the form of a obliquely split or other composed compressor housing 1. It is also possible to guide the suction duct 2, the pressure duct 3 or service tube 9 via the cover part into the interior of the compressor housing, with the suction duct 2, pressure duct 3 need not extend in a paired manner next to one another as shown in FIG. 1, but can also open into connection openings 10 arranged in any desired offset manner or can lead out of the same.

The service tube 9 is merely used for factory-filling the compressor housing 1 with a suitable case or also for filling with oil 4 whose purpose is described further below.

FIG. 2 shows a top view of the compressor housing 1 shown in FIG. 1 as an oblique view and forms the reference for the partial sectional view shown in FIG. 3 with the sectional guides A-A and B-B, which view shows a connection of the suction duct 2 and pressure duct 3 with the compressor housing 1. Suction duct 2 and pressure duct 3 pass through a disk-like connection element 7 through the connection openings 10 arranged in the compressor housing, which connection element is connected with the compressor housing 1 in a hermetically sealed way and is connected in a hermetically sealed manner with the suction duct 2 and pressure duct 3. Usually the fastening of the suction duct 2/pressure duct 3 occurs to the connection element 7 or the connection element 7 to the compressor housing 1 by means of welding or soldering.

An oil pump (not shown) is further arranged within the compressor housing 1 whose task it is to convey the already mentioned oil 4 with which the compressor housing 1 is filled to the mutually sliding parts of the piston-cylinder unit in order to lubricate and cool the same. Especially the bearings of the connecting rod on the crankshaft and piston are thus supplied continually with circulating oil 4.

On the other hand, the oil circulation also causes a cooling of the piston-cylinder unit and continuously dissipates the heat occurring there in the course of refrigerant compression.

Instead of an oil pump provided with a nozzle, it is also possible for the purpose of lubricating and cooling the piston-cylinder unit to provide a hollow duct along the axis of the perpendicularly arranged crankshaft, through which oil 4 collected at the floor in the basic part of the compressor housing 1 is conveyed upwardly in a suction effect due to the rotation of the crankshaft and is swirled during emergence from the hollow duct at the upper end of the crankshaft by means of rotational elements attached to the crankshaft and is supplied to the desired areas of the piston-cylinder unit. It needs to be prevented by suitable seals that the swirled oil 4 reaches the cylinder head and enters the cooling circulation with the refrigerant.

The use of so-called Archimedean spirals on the crankshaft for oil conveyance to the piston is also known.

Irrespective of which system is used specifically for ensuring the oil circulation, it occurs that the swirled and heated oil 4 will settle continually also on the compressor housing wall and will flow downwardly there in the direction of gravity (see FIG. 3). In this way, the heat absorbed by oil 4 can be passed on to the compressor housing 1 and subsequently be dissipated to the ambient environment.

In order to prevent that the oil 4 makes contact with the suction duct 2 or the pressure duct 3 while it flows down, for example on the section of suction duct 2 protruding into the compressor housing or in the area of the pressure tube guided through the wall of the compressor housing, thus causing a concomitant heat exchange from oil 4 to the suction duct 2 or the (hot) pressure duct 3 to the oil 4, which would then subsequently cause a heating of the compressor housing 1 and thus also the suction duct 2, at least one deflection means is provided in accordance with the invention which screens the suction duct 2 and the pressure duct 3 from any downwardly flowing oil 4.

The deflection means is arranged above the passage of the suction duct 2 or pressure duct 3 through the connection opening 10 of the compressor wall 1, with the distance from the deflection means to the suction duct 2/pressure duct 3 or to the connection element 7 enclosing the same being chosen individually depending on the application according to the size of the circulating oil volume, the type of the respective pumping and swirling technology, and the specific geometry of the interior space and the arrangement of the components of the refrigerant compressor. The distance however must not be so large that the fluid flow of the oil 4 guided past the deflection means can expand again in the direction of the suction duct 2/pressure duct 3 and might come into contact with the same.

In a preferred embodiment according to FIG. 4, the deflection means is arranged as a guide extension 5 which protrudes inwardly from the compressor housing wall. As is shown in the illustration in FIG. 4, the guide extension 5 screens the suction duct 2 and the pressure duct 3 from the oil 4 flowing downwardly on the compressor housing wall 1, such that the same can flow off or drip off along the longitudinal extension of the guide extension 5. The oil 4 thus passes the direct region of the passage of the suction duct 2 or pressure duct 3 through the connection opening 10 in the compressor housing wall 1 without coming into contact with the suction duct 2 or the pressure duct 3.

The guide extension 5 preferably concerns a component which is made separately and is attached to the inside of the compressor housing 1 by means of conventional joining techniques such as welding, soldering or gluing. If advantageous under the respective requirements of series production, the guide extension 5 can also be mounted by means of dowels, a latching joint or the like in the intended position. Integral production of the guide extension 5 with the compressor housing is possible and represents a simplification in production.

Although it is in the shape of an umbrella in accordance with FIG. 4, i.e. it is arranged with an upwardly convex longitudinal extension, the guide extension 5 can also be arranged in the shape of a V for example. In the case of a V-shaped arrangement, the tip of the V is arranged above the suction duct 2 or pressure duct 3 in the operating position of the compressor housing 1, so that the stream of oil 4 flowing down on the compressor housing wall is split at tip of the V to the left and right and flows down on the two legs of the V according to gravity without making contact with the suction duct 2 or pressure duct 3.

In order to guide the oil entirely about the suction duct 2 or pressure duct 3, the two legs of the V are pulled down beneath the suction duct 2 or pressure duct 3 and shield the suction duct 2 and pressure duct 3 in the manner of a gable roof.

It is understood that the present V-shape can be arranged in many variations, e.g. with curved sections of the longitudinal extension or the like.

It can further be advantageous to provide the longitudinal extension 5 with longitudinal grooves, i.e. with notches arranged along its longitudinal extension. It is thus prevented that an oil stream creeping around the guide extension 5 will reach the suction duct 2 or pressure duct 3 (not shown).

The problem of creeping oil quantities which move about the guide extension 5 and continue from the upper side of the guide extension 5 to its bottom side from where they then directly reach the suction duct 2 or pressure duct 3 can also be counteracted in the manner that the guide extension is provided with a cross sectional profile which is concave in the direction averted from the suction duct 2 or pressure duct 3 in the manner of a rain gutter. Such an embodiment is schematically shown in FIG. 6.

An arrangement of the guide extension according to FIG. 7, according to which the same encloses an acute angle or an angle $\alpha<90°$ with the section of the compressor housing wall extending above the contact point of the guide extension 5 with the compressor housing 1, can prevent the described creeping of the oil 4 because in this case the oil 4 which forms a brooklet 4' is guided according to gravitational tendencies along the inclination of the guide extension 5.

Instead of a guide extension 5 protruding inwardly on the compressor housing wall, at least one recess 6 in the compressor housing 1 can be used as a deflection means in an alternative embodiment according to FIG. 5. The recess profile that is chosen depends on the respectively employed production method and the individual arrangement. Examples for these are the shape of a simple V-notch, a simple groove, a T-groove, a dovetail groove or a rounded groove.

In any case, the provision of a recess 6 leads to the consequence that the oil 4 which flows down the compressor housing wall and meets the profiled recess 6 is guided further along the progression of recess 6 according to the illustration of FIG. 5 and is guided laterally past the suction duct 2 or pressure duct 3.

The relevant aspect in this embodiment is also that the recess 6 extends continuously over the suction duct 2 or pressure duct 3. In the case of a concrete arrangement of the recess 6 with respect to its longitudinal extension the same applies as has already been said with reference to the arrangement of the guide extension 5. Recess 6 can therefore also have any desired progression and be arranged in the manner of an umbrella or V-shaped for example.

Recess 6 is produced in the known manner by means of metal-cutting or non-cutting machining methods.

It may optionally be required to arrange several guide extensions 5 or recesses 6 on top of one another in order to exclude any contact of the downwardly flowing oil 4 with the suction duct 2 or pressure duct 3 by formation of drops and in order to completely exclude oil quantities flowing about the deflection means. When a recess 6 is provided beneath a guide extension 5 approximately parallel thereto, oil drops or oil quantities which creep about the same and overcome the guide extension 5 and further move in the direction of the suction duct 2 or pressure duct 3 are held back at the latest by recess 6 from making contact with the suction duct 2 or pressure duct 3.

The invention claimed is:

1. A hermetically encapsulated refrigerant compressor comprising:

a hermetically sealed compressor housing, in an interior of which operates a refrigerant-compressing piston-cylinder unit, the compressor housing having a compressor housing wall, a suction duct, via which refrigerant is conveyed:

into the compressor housing, or into a suction muffler connected to the piston-cylinder unit, a pressure duct, via which refrigerant is conveyed out of the compressor housing by the piston-cylinder unit, and at least one recess provided directly in the compressor housing wall and integrally formed as a single piece with the compressor housing wall;

wherein in an operating position the at least one recess is arranged above a passage of the suction duct or the pressure duct through the compressor housing wall such that the at least one recess prevents contact of oil flowing down the compressor housing wall with the suction duct or the pressure duct; and wherein the at least one recess is separated from the passage by a non-recessed portion of the compressor housing wall.

2. The hermetically encapsulated refrigerant compressor according to claim 1, further comprising at least one guide extension which protrudes inwardly from the compressor housing wall.

3. The hermetically encapsulated refrigerant compressor according to claim 2, wherein the guide extension comprises a groove-like cross-sectional profile or one that is concave in the direction averted in the suction duct or the pressure duct.

4. The hermetically encapsulated refrigerant compressor according to claim 1, wherein the at least one recess is substantially arranged in the shape of a V.

5. The hermetically encapsulated refrigerant compressor according to claim 4, wherein the two legs of the V extend until beneath the suction duct or the pressure duct.

6. The hermetically encapsulated refrigerant compressor according to claim 1, wherein the at least one recess is arranged substantially in the manner of an umbrella or has an upwardly convex longitudinal extension.

7. The hermetically encapsulated refrigerant compressor according to claim 1, wherein several deflection elements are arranged on top of one another.

8. The hermetically encapsulated refrigerant compressor according to claim 1, wherein at least one of the suction duct and the pressure duct is arranged in a tubular way.

* * * * *